United States Patent [19]

Meyer

[11] Patent Number: 4,764,184

[45] Date of Patent: Aug. 16, 1988

[54] APPARATUS FOR THE GASIFICATION OF COAL

[75] Inventor: Philippus J. Meyer, Secunda, South Africa

[73] Assignee: Sasol Operations (Proprietary) Limited, Johannesburg, South Africa

[21] Appl. No.: 1,007

[22] Filed: Jan. 6, 1987

[30] Foreign Application Priority Data

Jan. 10, 1986 [ZA] South Africa ..... 86/0209

[51] Int. Cl.[4] ..... C10J 3/30; C10J 3/32; C10J 3/82

[52] U.S. Cl. ..... 48/77; 48/86 R; 414/206

[58] Field of Search ..... 48/63, 64, 76, 77, 86 R, 48/87, 73; 110/229; 414/160, 205, 206; 202/241

[56] References Cited

U.S. PATENT DOCUMENTS

| | | | |
|---|---|---|---|
| 380,910 | 4/1888 | McGee | 202/241 |
| 735,493 | 8/1903 | Gayner | 202/241 |
| 891,713 | 6/1908 | Mond | 414/205 |
| 976,933 | 11/1910 | Schniewind | 202/241 |
| 1,412,118 | 4/1922 | Johnston . | |
| 1,772,819 | 8/1930 | Schumacher | 48/86 R |
| 1,896,779 | 2/1933 | Loebell | 48/73 |
| 2,619,344 | 11/1952 | Mysch | 414/206 |
| 3,997,407 | 1/1976 | Fujii et al. | |
| 4,134,738 | 1/1979 | Bress et al. . | |
| 4,165,970 | 8/1979 | Rudolph et al. . | |
| 4,426,809 | 1/1984 | Kupfer et al. | 48/86 R |
| 4,643,109 | 2/1987 | Meyer | 48/86 R |
| 4,643,739 | 2/1987 | Schuster et al. | 48/86 R |

FOREIGN PATENT DOCUMENTS

| | | | |
|---|---|---|---|
| 94220 | 9/1923 | Austria . | |
| 308252 | 10/1918 | Fed. Rep. of Germany | 48/86 R |
| 621666 | 10/1935 | Fed. Rep. of Germany | 48/86 R |
| 133819 | 1/1979 | Fed. Rep. of Germany | 48/86 R |
| 147547 | 4/1981 | Fed. Rep. of Germany | 48/63 |
| 66243 | 10/1972 | German Democratic Rep. . | |
| 133817 | 1/1979 | German Democratic Rep. . | |
| 212770 | 3/1924 | United Kingdom . | |
| 369089 | 3/1932 | United Kingdom . | |
| 392496 | 5/1933 | United Kingdom . | |
| 429150 | 5/1935 | United Kingdom . | |
| 534912 | 3/1941 | United Kingdom . | |
| 2115436 | 9/1983 | United Kingdom . | |

*Primary Examiner*—Peter Kratz

*Attorney, Agent, or Firm*—Dressler, Goldsmith, Shore, Sutker & Milnamow, Ltd.

[57] ABSTRACT

A fixed-bed coal gasifier includes an upright cylindrical wall providing a fixed-bed coal gasification chamber for gasifying coal to produce synthesis gas, with an end-piece closing off the upper end of the cylindrical wall. A coal inlet opening is provided in the end-piece, and a gas outlet leads from the chamber at a high level. A gas collection device is provided within the gasification chamber below the inlet opening, and provides a central gas collection zone operatively connected to the gas outlet of the gasification chamber so that synthesis gas produced in the chamber can pass from the gas collection zone to the gas outlet. The device is spaced with clearance from the cylindrical wall so that coal can pass through the gap between the device and the cylindrical wall. A plurality of horizontally spaced coal distribution means, for distributing coal from an upper zone above the gas collection device into a lower zone immediately below the gas collecting device, are also provided.

8 Claims, 3 Drawing Sheets

APPARATUS FOR THE GASIFICATION OF COAL

THIS INVENTION relates to the gasification of coal. It relates in particular to a coal gasifier, and to a gas collection device for a coal gasifier.

According to a first aspect of the invention there is provided a fixed-bed coal gasifier, which includes

- an upright cylindrical wall providing a fixed-bed coal gasification chamber for gasifying coal to produce synthesis gas, with an end-piece closing off the upper end of the cylindrical wall;
- a coal inlet opening in the end-piece;
- a gas outlet leading from the chamber at a high level;
- a gas collection device within the gasification chamber below the coal inlet opening, and providing a central gas collection zone operatively connected to the gas outlet of the gasification chamber so that synthesis gas produced in the chamber can pass from the gas collection zone to the gas outlet, the device being spaced with clearance from the cylindrical wall so that coal can pass through the gap between the device and the cylindrical wall; and
- a plurality of horizontally spaced coal distribution means, for distributing coal from an upper zone above the gas collection device into a lower zone immediately below the gas collecting device.

The gas collection device may include a housing providing said gas collection zone, and having a gas inlet leading into it at a low level, with the operative connection leading from the housing at a higher level.

The housing may comprise a hollow frustoconically-shaped skirt, the smaller opening of the skirt being directed upwardly and being closed off, and its larger opening being directed downwardly.

The cylindrical wall of the gasification chamber may be substantially circular when seen in plan view. The skirt may be located concentrically within the gasification chamber wall. The coal inlet may be located centrally in the end-piece.

The gasifier may include a coal distribution device located between the coal inlet opening and the gas collection device skirt. The skirt may be located immediately below the coal distribution device. The coal distribution device may comprise at least one frustoconically-shaped skirt-like member having its smaller opening directed upwardly. The skirt-like member may be hollow, and at least its lower end may be open.

The upper end of the gas collection device skirt may be located within the skirt-like member of the coal distribution device so that the devices overlap each other in such a manner that a concentric or annular opening is provided between the coal distribution device and the gas collection device.

The coal distribution device may comprise a first hollow open-ended frustoconically-shaped skirt-like member located below the coal inlet opening, and a second hollow open-ended frustoconically-shaped skirt-like member located below the first skirt-like member and spaced with clearance therefrom, with the second skirt adapted to distribute coal passing from the first skirt into the space below the first skirt.

The diameter of the smaller opening of the first skirt-like member may be substantially the same as that of the coal discharge opening, and may be aligned therewith. The gasifier may then include a circular disc-like member movable downwardly from a first position in which it closes off the coal inlet opening, to a second position in which it is spaced with clearance from said opening, so that coal can then be fed into the chamber. The closure member, in the second position, may also close off the smaller upper opening of the first skirt-like member.

The diameter of the upper opening of the second skirt-like member may be smaller than the diameter of the bottom or larger opening of the first skirt-like member. The top of the second skirt-like member may be so spaced from the bottom of the first skirt-like member that no bridging will take place in the coal flow down the gasification chamber.

The second skirt-like member may comprise an upper section and a lower section. The upper section may be attached to the wall of the gasification chamber, and the first skirt-like member may be connected to the upper section, thereby locating the first skirt-like member in position in the chamber. The connection of the upper section of the second skirt-like member to the first skirt-like member may be effected by means of a plurality of circumferentially spaced connectors extending between the upper section and the first skirt-like member. The attachment of the upper section to the wall of the chamber may be effected by means of lugs extending between at least some of the connectors and the chamber wall.

The lower section may also be attached to the wall of the chamber. The attachment of the lower section of the second skirt-like member to the wall may be effected by means of a plurality of attachment means extending between it and the wall. The attachment means may be spaced apart circumferentially about the lower section.

The operative connection of the gas collection device skirt to the gas outlet may be by means of a conduit leading from the inside of the skirt to the gas outlet and having a gas inlet opening within the skirt.

The gasifier may also include an opening in the gasification chamber wall, with the conduit extending from this opening to the gas outlet. The opening may be located diametrically opposite the gas outlet so that the conduit extends linearly from the opening, through the skirt near its upper end, to the gas outlet. The conduit may be provided at its centre with at least one gas inlet opening. Preferably, a plurality of the gas inlet openings, spaced circumferentially from one another, may be provided. The gas inlet openings may be of elongate form extending in the direction of the axis of the conduit, which may be circular in cross-section. The skirt will be secured sealingly to the conduit to prevent passage of gases at the joints between the skirt and the conduit.

The gasifier may further include a conduit cleaner adapted to clean deposits from the inside of the conduit. The conduit cleaner may comprise a displaceable cleaning head located snugly within the conduit, and an elongate actuating member extending from the cleaning head through the opening in the chamber wall so that it can be operated from outside the gasifier.

The coal distribution means associated with the gas collection device may each comprise a coal passageway depending vertically downwardly through the skirt. The coal passageways may be located on either side of the conduit, when the gasifier is seen in plan view. The same number of passageways may be provided on either side of the conduit. The coal passageways may be provided by hollow open-ended circular cylindrical or conical conduits mounted at their upper ends to teh skirt so that the upper openings of these conduits constitute coal inlet openings located on the outside of the skirt. The cylinders may extend down to the same level as the lower opening of the skirt. When the conduits are conically-shaped, their smaller openings will be located uppermost.

The gasifier may include an ash discharge outlet leading from the chamber at a low level, and ash discharge means for discharging ash from the chamber via the ash discharge outlet. It may also include a coal lock mounted on top of the chamber, with the end-piece constituting a portion of the coal lock.

The gasifier may be a LURGI (trade name) gasifier, in which the ash discharge means is in the form of a circular (when seen in plan view) grate mounted to rotate above the ash outlet, and in which the outlet is an annular outlet.

The chamber wall may comprise outer and inner skins spaced apart so that a cavity is provided between them, the cavity containing water, so that the inner skin and the water-filled cavity constitute a water jacket along the inside of the outer skin.

According to a second aspect of the invention, there is provided a gas collection device for a fixed-bed coal gasifier having an upright cylindrical wall providing a gasification chamber for gasifying coal in, with the upper end of the cylindrical wall closed off with an end-piece, a coal inlet opening in the end-piece, a gas outlet leading from the chamber at a high level, the gas collection device including

- a housing locatable within the gasification chamber, and providing a gas collection zone having a gas inlet leading into it and a gas outlet operatively connectable to the gas outlet of the gasifier; and
- a plurality of spaced coal passageways extending through the housing.

The invention will now be described by way of example with reference to the accompanying diagrammatic drawings.

Figure 1:
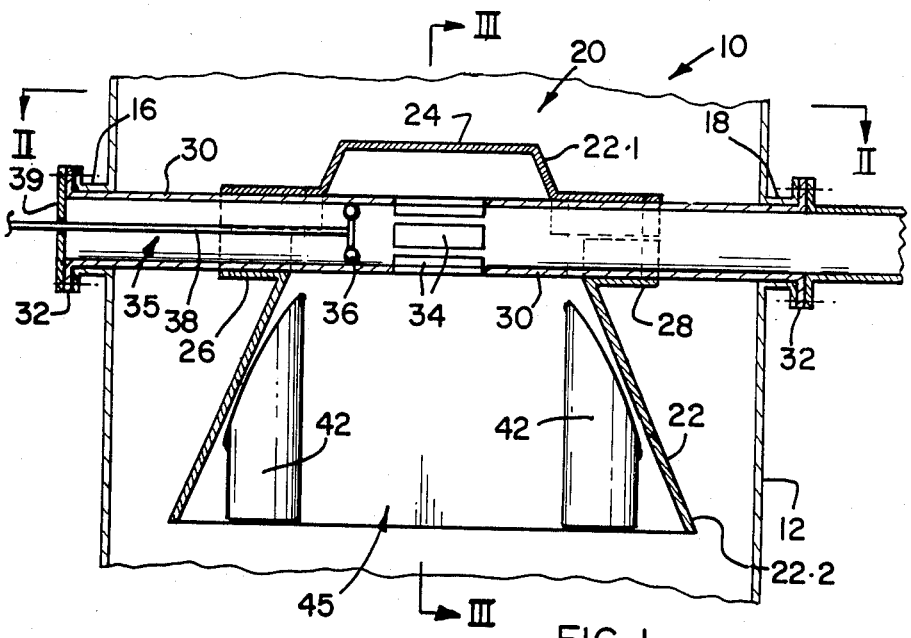
FIG. 1 shows, in part, a longitudinal sectional view of a coal gasifier according to one embodiment of the first aspect of the invention.
Figure 2:
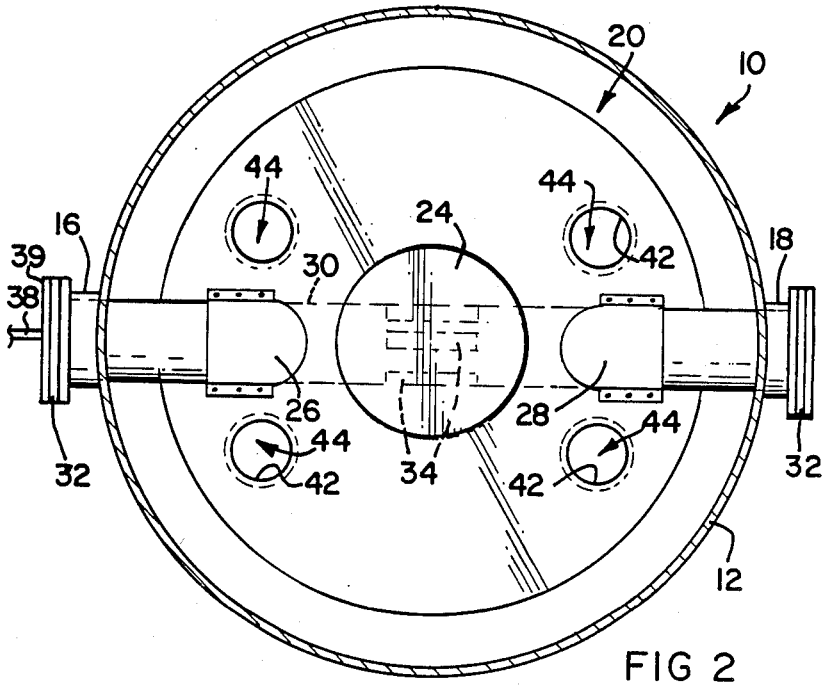
FIG. 2 shows a sectional view through II—II in FIG. 1, with details omitted for clarity.
Figure 3:
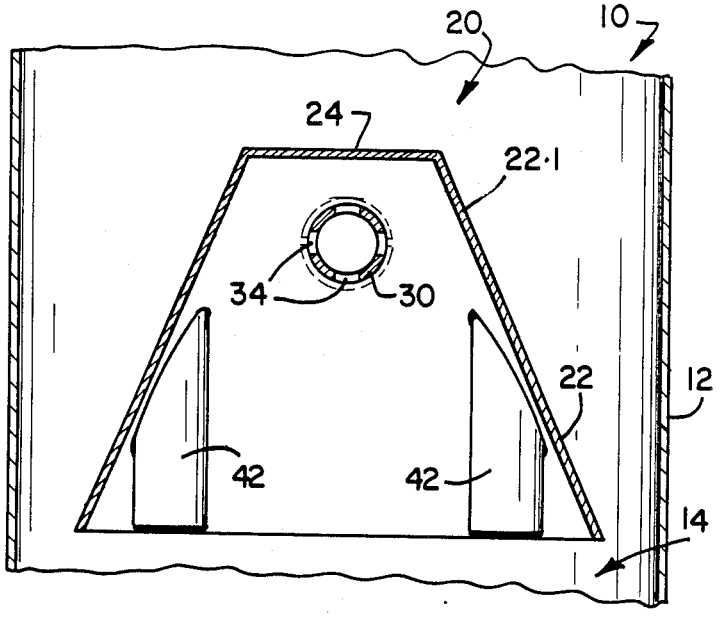
FIG. 3 shows a longitudinal sectional view through III—III in FIG. 1.

Referring to FIGS. 1 to 3, reference numeral 10 generally indicates a fixed-bed dry-bottom coal gasifier according to one embodiment of the first aspect of the invention.

The gasifier 10 includes an upwardly extending round cylindrical wall 12 providing a coal gasification chamber 14 normally containing a coal bed (not shown), as well as an ash bed (not shown) below the coal bed. The gasifier 10 also includes a coal lock (not shown) above the chamber. The coal lock has a more or less centrally located coal discharge opening (not shown) leading into the top of the chamber. The floor of the coal lock hence constitutes an end-piece closing off the upper end of the chamber, with the coal lock coal discharge opening constituting a coal inlet to the chamber. The gasifier 10 further includes an ash discharge outlet (not shown) leading from the chamber at a low level, and discharge means in the form of a grate (not shown) for discharging ash from the chamber via the ash discharge outlet. The gasifier 10 still further includes a sleeve-shaped gas outlet 18 leading from the chamber 14 at a high level, as well as a sleeve-shaped opening 16 in the chamber wall, diametrically opposite the gas outlet 18.

The gasifier 10 also includes a gas collection device, generally indicated by reference numeral 20, located within the chamber 14.

The gas collection device 20 includes a hollow frustoconically-shaped skirt 22. The end 22.1 of the skirt 22, which has the smaller opening, is closed off by means of a closure plate 24, and is directed upwardly. Hence, the larger opening is provided at its other end 22.2, and is directed downwardly. The skirt 22 is located concentrically within the chamber 14, and is located with clearance from the chamber wall 12. The skirt includes a pair of diametrically opposed, radially outwardly extending sleeves 26, 28, of which sleeve 28 constitutes a gas outlet. The sleeves 26, 28 are split axially and are connectable together by suitable means, eg by being welded together.

The device 20 also includes a straight conduit 30 which is also circular in cross-section. The dimensions of the conduit are such that it fits snugly through the sleeves 26, 28, as well as snugly through the outlet 18 and the opening 16. The respective ends of the conduit 30 are provided with radially outwardly extending circumferential flanges 32. A plurality of equi-sized elongate, circumferentially spaced gas openings 34 are provided in the conduit, and are arranged around the conduit 30. The openings 34 extend in the direction of the axis of the conduit 30, and are located within the skirt 22. A conduit cleaner 35 comprising a circular cleaning head 36 and an elongate actuator or stem 38 protruding from the lead 36, is located within the conduit 30. The dimensions of the cleaning head 36 are such that it fits snugly within the conduit. The end of the conduit 30 which protruces through the opening 16 is closed off by means of an end plate 39, the stem 38 passing slidingly yet sealingly through an aperture in the end plate 39. The cleaning head can hence be displaced along the conduit, and rotated if desired, by means of the actuator 38, thereby to clean deposits from the inside of the conduit.

Four circular section conduits 42, providing coal passageways, depend downwardly from the skirt 22 through the inside of the skirt, ie through a gas collection zone 45 provided by the inside of the skirt. The passageways extend down to the same level as the lower end 22.2 of the skirt 22. The upper ends of the conduits are mounted to the skirt 22. The conduits 42 are arranged in pairs on either side of the conduit 30. Upper openings 44 of the conduits 42 constitute coal inlet openings and are located at a level below the conduit 30. The openings 44 are located on the outside of the skirt 22.

In other embodiments (not shown), a greater or lesser number of conduits 42 and/or conduits of different configuration, eg downwardly outwardly flaring conical configuration, can be provided.

In use, the gasifier 10 will normaly be operated so that the skirt 22 is located at least partly within the coal bed. Coal can be added to the chamber 14 via the coal discharge outlet of the coal lock. Coal (not shown) can then pass from the closure or end plate 24 along the outer surface of the skirt 22 and over the lower peripheral edge of the skirt. Coal can also pass into the conduits 42 via the openings 44, to be distributed into the area or zone below the skirt 22. This will normally occur when the coal bed level is sufficiently high, eg the skirt 22 located wholly within the coal bed, so that the skirt provides said substantially coal-free gas collection zone 45 within the coal bed. Synthesis gas generated by the combustion of the coal in the gasification chamber 14 collects in the gas collection zone 45. This gas passes through the openings 34 in the conduit 30, and out of the chamber 14 via the gas outlet 18.

Impurities in this gas will adhere to the inner wall of the conduit 30. These deposits can be removed by reciprocating the conduit cleaner 35, ie moving it to and fro, along the conduit 30.

Figure 4:
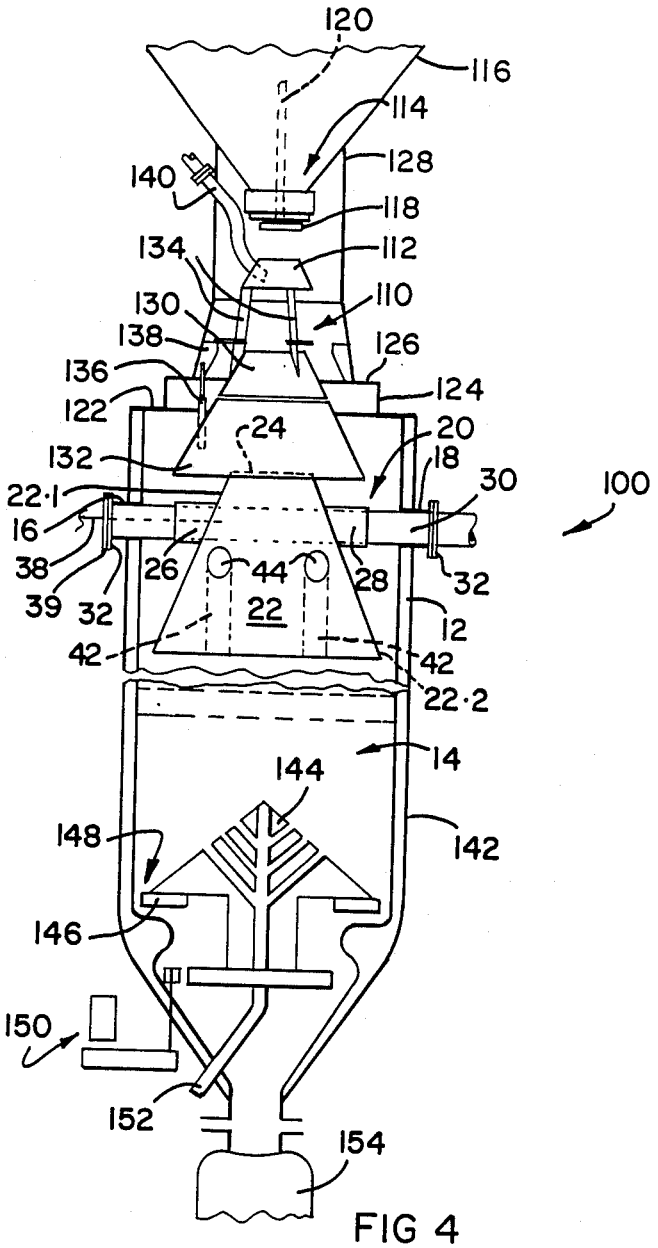
FIG. 4 shows, schematically, a longitudinal sectional view of a coal gasifier according to another embodiment of the first aspect of the invention.

Referring to FIG. 4, reference numeral 100 generally indicates a fixed-bed dry-bottom coal gasifier according to another embodiment of the first aspect of the invention.

Parts of the gasifier 100 which are the same are similar to those of the gasifier 10 hereinbefore described with reference to FIGS. 1 to 3, are indicated with the same reference numerals.

The upper end of the gasifier chamber 14 of the gasifier 100 is partly closed off by means of an annular closure member 122. A round ring-like portion 124 extends upwardly from the member 122. A further annular closure member 126 extends radially inwardly from the portion 124, and a round cylindrical member 128 extends between the closure member 126 and a lowermost tapering portion of a coal lock 116 mounted above the chamber 14. The coal lock has a centrally located coal discharge opening 114, which provides an inlet opening to the chamber. The coal lock is provided with a circular disc-like closure member 118 fitted to the lower end of an axially reciprocable rod or shaft 120.

The gasifier 100 includes a coal distribution device, generally indicated by reference numeral 110, located immediately above the gas collection device 20.

The coal distribution device 110 includes a first hollow frustoconically-shaped skirt-like member or coal distributor 112 located immediately below the coal discharge opening 114 of the coal lock 116. The coal distributor 112 is located within the cylindrical member 128. The rod 120 can be actuated by actuating means (not shown) to move the closure member 118 from its closed position indicated in FIG. 4, to an open position in which it closes off the upper end of the distributor 112.

The coal distribution device 110 also includes a second coal distributor comprising an upper hollow open-ended frusto-conical section 130; a lower hollow open-ended frusto-conical section 132; axially extending circumferentially spaced connecting members 134 connecting the distributor 112 to the upper section 130; and a plurality of axially extending circumferentially spaced attachment means 136 securing the lower section 132 to lugs or supports 138 protruding radially inwardly from the member 128. The connecting members 134 are also connected to the supports 138.

The upper opening of the skirt 22 is located within the lower opening of the lower section 132 so that the lower section 132 overlaps the skirt 22 in a vertical direction. Hence, an annular downwardly directed opening is provided between the skirt 22 and the section 132.

The gasifier 100 further includes an injection pipe 140 terminating within the distributor 112, for feeding a tar/fine coal mixture or byproduct back into the gasification chamber for regasification.

A further wall 142 is provided around the chamber wall 12, and defines a water jacket around the chamber wall.

The gasifier 100 still further includes a rotatable grate 144, provided with scraper blades 146, in the bottom of the chamber. An annular ash discharge opening 148 is provided between the periphery of the grate 114 and the chamber wall 12. Drive means 150, for driving the grate 144 to rotate, is also provided. A steam/oxygen supply conduit 152 leads into the gasifier below the grate, and has a discharge opening in the outer surface of the grate. An ash lock 154 is provided below the ash discharge opening.

In use, coal is discharged from the coal lock 116 onto a coal bed in the chamber 14. Coal initially passes around the outside of the distributor 112 and the sections 130, 132, until the upper level of the coal bed is more or less at the same level as the upper opening in the section 130. This coal will be a more or less homogeneous mix of coarse and fine coal. It will be appreciated that coal will not accumulate inside the skirt 22 to a significant degree. Further coal added will then pass into the space between the bottom of the distributor 112 and the top of the section 130, and through the upper opening of the section 132. This coal initially passes through the passageways 42 in the skirt 22, as hereinbefore described, thereby to be distributed into the space or zone immediately below the skirt 22. When this space is full, the passageway 42 and thereafter the section 132 itself fills up with coal.

In known gasifiers of this type, eg those available under the trade name LURGI, synthesis gas usually permeates to the upper regions of the chamber and is withdrawn from the gasification chamber 14 directly via the gas outlet 18. Non-symmetric or asymmetric upward flow of gas usually occurs in the chamber 14 as a result. Since the synthesis gas tends to follow a path of least resistance, ie the shortest path, through the coal bed, gas flow along the chamber wall 12 immediately below the gas outlet 18 is promoted. This leads to hotter combustion temperatures being experienced alongside this portion of the chamber wall, which can result in damage, eg cracking, of the chamber wall 12.

This problem is further aggravated by the fact that, in these known gasifiers, when the coal is dumped into the gasification chamber from the coal lock during the normal loading cycle of the gasifier, the coal free-falls some distance into the gasification chamber. When this pulverized or comminuted coal has a normal particle size distribution, the larger or coarser coal particles tend to accumulate against the wall of the chamber, and hence also below the gas outlet 18, while the finer particles tend to accumulate at the centre of the chamber. During subsequent gasification of the coal by means of a gasifying agent in the form of a mixture of steam and oxygen, the coal moves slowly downwardly towards a fire bed located at a lower level. The gasifying agent, which enters the gasification chamber at or near its bottom via outlet or discharge openings in the circular rotating grate, tends to follow an upwardly extending path or least resistance through the coal bed, ie it passes preferentially through the coarser coal particles located against the chamber wall. The inner surfaces of the chamber wall, which are usually fairly smooth, contribute to this problem. Hence, as mentioned above, coal combustion is enhanced in the region of the walls of the chamber, especially the portion of the wall below the outlet 18. The Applicant has found that this leads to over-heating of and subsequent damage to the jacket wall, as stated above; poor gasifier operation, especially if the coal contains a large proportion of fines, etc.

The Applicant believes that, with the gas collection device 20, these problems will at least be reduced since the skirt 22 promotes a more symmetric or even gas flow up the coal bed. Furthermore, the passageways 42 ensure a more homogeneous or concentric distribution of coal within the coal bed, ie the coarse particles do not accumulate preferentially at the chamber walls.

This the Applicant believes will lead to advantages such as more stable gasifier operation, higher gasifier loadings, a greater coal reserve, ie the space within the gasification chamber can be utilized more efficiently so that a larger coal bed loading will be achieved with a similar coal bed height, and a reduction in carry-over of fines with the gas as a result of the relatively large coal bed/gas interface immediately below the skirt 22.

I claim:

1. A fixed-bed coal gasifier which includes an upright cylindrical wall providing a fixed-bed coal gasification chamber for gasifying coal to produce synthesis gas, with an end-piece closing off the upper end of the cylindrical wall;

a coal inlet opening in the end-piece;

a gas outlet opening in the chamber wall at a high level;

a gas collection housing defining a skirt having a gas inlet opening at a low level, within the gasification chamber below the coal inlet opening, the housing providing a central gas collection zone, with the outer periphery of the housing being spaced with clearance from the cylindrical wall and being constructed so that coal can pass through the gap between the housing and the cylindrical wall, and with the housing constructed to distribute coal radially outwardly from a region located centrally in the chamber above the housing;

a gas conduit leading from the gas collection zone at a level above the gas inlet opening, to the gas outlet opening, for withdrawing gas from the center of the gas collection zone, wherein the gas conduit has a gas inlet opening within the skirt, and the skirt being secured sealingly to the conduit to prevent passage of gases at joints between the skirt and the conduit; and a plurality of horizontally spaced coal conduits, providing coal passageways, depending downwardly within the housing, for distributing coal from an upper zone above the housing, into a lower zone within the vertical projection of the outer housing periphery.

2. A gasifier as claimed in claim 1, wherein the skirt comprises a hollow frustoconically-shaped skirt, the smaller opening of the skirt being directed upwardly and being closed off, and its larger opening being directed downwardly and constituting the gas inlet opening.

3. A gasifier as claimed in claim 2, wherein the cylindrical wall of the gasification chamber is substantially circular, with the skirt being located concentrically within the gasification chamber wall.

4. A gasifier as claimed in claim 2, which includes a coal distribution device located between the coal inlet opening and the gas collection device skirt, with the skirt being located immediately below the coal distribution device and at least a portion of the coal distribution device being located below the normal coal level in the chamber.

5. A gasifier as claim in claim 4, wherein the coal distribution device comprises at least one hollow frustoconically-shaped skirt-like member having its smaller opening directed upwardly, with the upper end of the gas collection device skirt being located within the skirt-like member of the coal distribution device so that the device and housing overlap each other in such a manner that the concentric or annular opening is provided between the housing and the gas collection device.

6. A gasifier as claimed in claim 2, wherein a further opening is provided in the chamber wall diametrically opposite the gas outlet opening, with the gas conduit extending diametrically across the chamber from the further opening, through the skirt, to the gas outlet.

7. A gasifier as claimed in claim 6, wherein the coal conduits are mounted at their upper ends to the skirt so that the upper openings of these conduits constitute coal inlet openings located on the outside of the skirt, the coal conduits being located on either side of the gas conduit.

8. A gasifier as claimed in claim 7, wherein the conduits extend down to the same level as the lower opening of the skirt.

* * * * *